US008865264B2

(12) United States Patent
Haack et al.

(10) Patent No.: US 8,865,264 B2
(45) Date of Patent: Oct. 21, 2014

(54) PLASMA COATINGS AND METHOD OF MAKING THE SAME

(71) Applicant: Ford Global Technologies, LLC, Dearborn, MI (US)

(72) Inventors: Larry P. Haack, Ann Arbor, MI (US); Ann Marie Straccia, Southgate, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/917,064

(22) Filed: Jun. 13, 2013

(65) Prior Publication Data

US 2013/0280435 A1 Oct. 24, 2013

Related U.S. Application Data

(60) Continuation of application No. 13/470,469, filed on May 14, 2012, now abandoned, which is a division of application No. 12/198,180, filed on Aug. 26, 2008, now Pat. No. 8,197,909.

(51) Int. Cl.

| | |
|---|---|
| ***C23C 4/12*** | (2006.01) |
| ***B05D 1/00*** | (2006.01) |
| *B05D 1/02* | (2006.01) |

(52) U.S. Cl.

CPC . *C23C 4/127* (2013.01); *B05D 1/02* (2013.01); *B05D 1/62* (2013.01)

USPC ..... 427/446; 427/447

(58) Field of Classification Search

USPC ..... 427/446, 447

See application file for complete search history.

(56) References Cited

U.S. PATENT DOCUMENTS

| | | | | |
|---|---|---|---|---|
| 4,048,348 | A * | 9/1977 | Bailey et al. | 427/452 |
| 5,047,612 | A | 9/1991 | Savkar et al. | |
| 5,243,169 | A | 9/1993 | Tateno et al. | |
| 5,573,682 | A | 11/1996 | Beason, Jr. et al. | |
| 5,679,167 | A | 10/1997 | Muehlberger | |
| 5,718,967 | A | 2/1998 | Hu et al. | |
| 5,795,626 | A | 8/1998 | Gabel et al. | |
| 5,853,815 | A | 12/1998 | Muehlberger | |
| 6,666,016 | B2 | 12/2003 | Papamoschou | |
| 6,905,773 | B2 | 6/2005 | Hein et al. | |
| 2002/0012743 | A1 | 1/2002 | Sampath et al. | |
| 2006/0219598 | A1 | 10/2006 | Cody et al. | |
| 2007/0065582 | A1 | 3/2007 | Haack et al. | |
| 2010/0055476 | A1 | 3/2010 | Haack et al. | |

FOREIGN PATENT DOCUMENTS

| | | | |
|---|---|---|---|
| GB | 2430395 | A | 3/2007 |
| WO | 2007072120 | A1 | 6/2007 |

* cited by examiner

*Primary Examiner* — Elena T Lightfoot

(74) *Attorney, Agent, or Firm* — Damian Porcari; Brooks Kushman P.C.

(57) ABSTRACT

A method of coating a substrate surface. The method includes plasma spraying a direct-spray component onto a substrate surface, and plasma spraying an over-spray component onto the substrate surface. The direct-spray and over-spray components form a plasma coating surface contacting at least a portion of the substrate surface.

20 Claims, 7 Drawing Sheets

PLASMA COATINGS AND METHOD OF MAKING THE SAME

CROSS-REFERENCE TO RELATED APPLICATIONS

This application is a continuation of U.S. application Ser. No. 13/470,469 filed May 14, 2012, now abandoned, which is a divisional of U.S. application Ser. No. 12/198,180 filed Aug. 26, 2008, issued as U.S. Pat. No. 8,197,909 on Jun. 12, 2012. The disclosures of which are incorporated in their entirety by reference herein.

TECHNICAL FIELD

One or more embodiments of the present invention relate to plasma coatings and methods of making the same.

BACKGROUND

Plasma coatings are used for modifying surface characteristics of a material to control surface energy of the material for promoting bonding, creating lubricity, providing corrosion protection, and/or improving scratch resistance.

Plasma coatings such as those formed through atmospheric pressure air plasma (APAP) may be applied through an in-line process with higher deposition rates and at appreciably shorter cycle times. Since APAP coatings are deposited in an air atmosphere, the type and/or the chemistry of monomers that are suitable for use in an APAP coating process may be limited.

Moreover, uncontrolled over-spray associated with plasma coating processes may be problematic for many coating applications. Often generated through a penumbra of APAP plasma, an over-spray of an air plasma may affect coating homogeneity in an undesirable fashion. For example, an uncontrolled over-spray may induce random formation of multiple coating layers with uncontrolled chemical content and hence an undesirable heterogeneous composition.

SUMMARY

In one embodiment, a method of coating a substrate surface is disclosed. The method includes plasma spraying a direct-spray component onto a substrate surface, and plasma spraying an over-spray component onto the substrate surface. The direct-spray and over-spray components form a plasma coating surface contacting at least a portion of the substrate surface. In certain variations, the first and second plasma spraying steps are performed simultaneously to form the plasma coating surface. The direct-spray component may include a single bounded direct-spray region, and the over-spray component may include a single bounded over-spray region adjacent to the single bounded direct-spray region. In other variations, the direct-spray component may include a single bounded direct-spray region, and the over-spray component may include first and second discrete over-spray subcomponents including first and second bounded over-spray regions adjacent to the single bounded direct-spray region. In one rendition, the first and second bounded over-spray regions are not adjacent to each other. The direct-spray and over-spray components may each have a different cross-linked polymer chemistry. In one variation, the first and second plasma spraying steps are performed in a single pass to form the plasma coating surface.

In another embodiment, a method of coating a substrate surface is disclosed. The method includes plasma spraying a direct-spray component onto a substrate surface, and plasma spraying an over-spray component onto the substrate surface. The direct-spray and over-spray components form a plasma coating surface contacting less than the entire substrate surface. In certain variations, the first and second plasma spraying steps are performed simultaneously to form the plasma coating surface. The direct-spray component may include a single bounded direct-spray region, and the over-spray component may include a single bounded over-spray region adjacent to the single bounded direct-spray region. In other variations, the direct-spray component may include a single bounded direct-spray region, and the over-spray component may include first and second discrete over-spray subcomponents including first and second bounded over-spray regions adjacent to the single bounded direct-spray region. In one rendition, the first and second bounded over-spray regions are not adjacent to each other. The direct-spray and over-spray components may each have a different cross-linked polymer chemistry. In one variation, the first and second plasma spraying steps are performed in a single pass to form the plasma coating surface.

In yet another embodiment, a method of coating a substrate surface is disclosed. The method includes plasma spraying a direct-spray component onto a substrate surface, and plasma spraying an over-spray component onto the substrate surface. The direct-spray component and the over-spray component may each have different cross-linked polymer chemistry. The first and second plasma spraying steps are performed in a single pass to form the plasma coating surface. The first and second plasma spraying steps may be performed simultaneously to form the plasma coating surface. In one variation, the direct-spray component may include a single bounded direct-spray region, and the over-spray component may include a single bounded over-spray region adjacent to the single bounded direct-spray region. In another variation, the direct-spray component may include a single bounded direct-spray region, and the over-spray component may include first and second discrete over-spray subcomponents including first and second bounded over-spray regions adjacent to the single bounded direct-spray region. In yet another variation, the first and second bounded over-spray regions are not adjacent to each other.

BRIEF DESCRIPTION OF THE DRAWINGS

The foregoing and other features of the present invention will become more apparent to one skilled in the art upon consideration of the following description of one or more embodiments of the present invention and the accompanying drawings in which.

DETAILED DESCRIPTION

Figure 1:
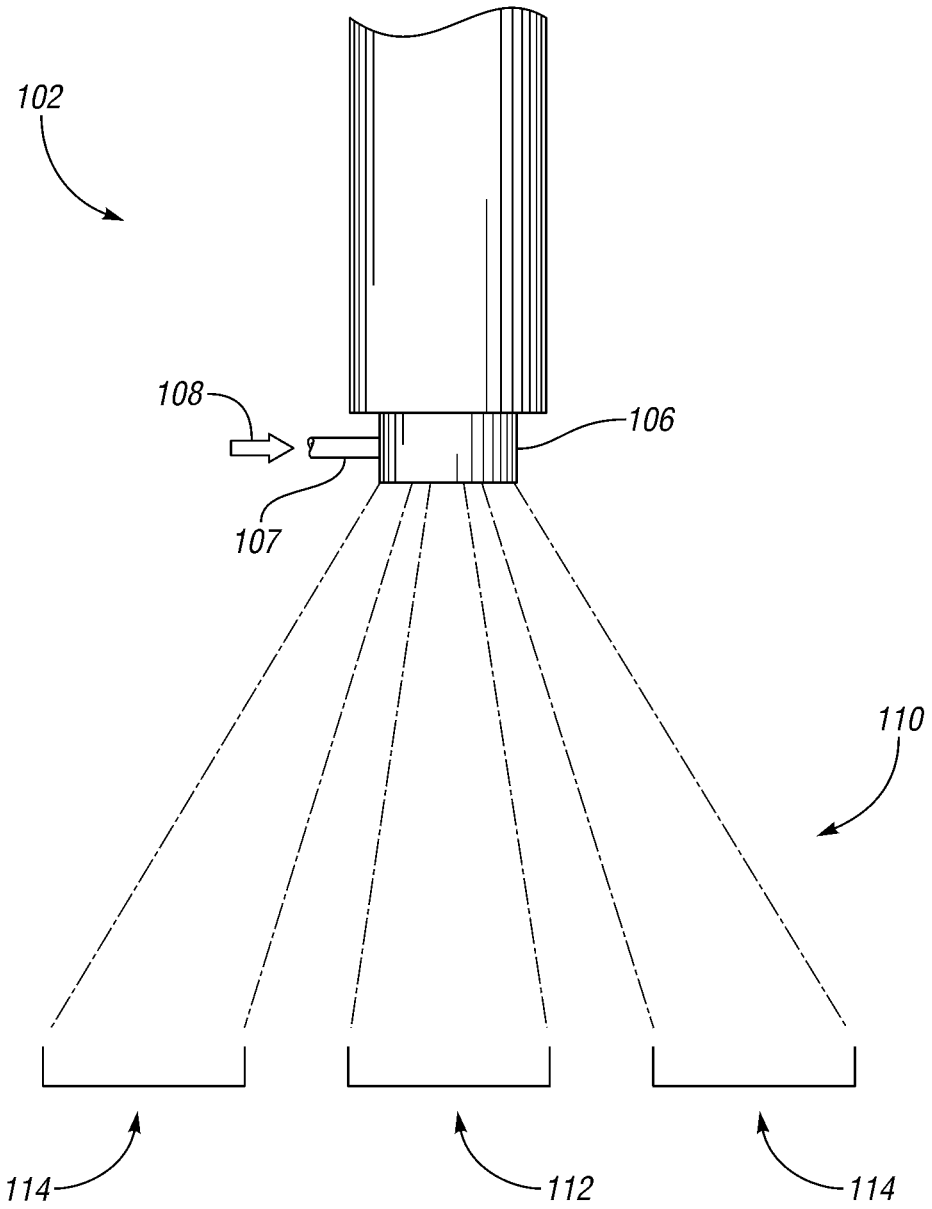
FIG. 1 depicts a plasma gun according to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Except where expressly indicated, all numerical quantities in this description indicating amounts of material or conditions of reaction and/or use are to be understood as modified by the word "about" in describing the broadest scope of the present invention. Practice within the numerical limits stated is generally preferred.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

It has been found that an over-spray generated during a plasma coating process using pre-polymer molecules forms a cross-linked coating with properties such as hexane stability comparable to a coating formed by a direct impingement spray, otherwise referred to herein as a direct-spray. When assessed by sonication with hexane treatment, the coating formed by the over-spray is found to be cross-linked in a way substantially similar to the type and extent of the cross-liking observed with a coating formed by the direct-spray. As such, rather than minimizing the over-spray as conventionally disclosed, an over-spay of a plasma is advantageously utilized in at least one embodiment.

As used in convention with one or more embodiments, the term "hexane stability" refers to the property of a cross-linked coating that withstands hexane extraction coupled with sonication. When hexamethyldisiloxane (otherwise referred to as "HMDSO") is used as a pre-polymer molecule to form a HMDSO-derived plasma coating, HMDSO coatings that are properly cross-linked are not susceptible to hexane extraction while HMDSO coatings that fail to be properly cross-linked may dissolve in a hexane solution and become visibly separated from the substrate coating.

It has also been found that a direct-spray and an over-spray of a plasma may be adjusted in both spray profile and spray content such that chemistry, hydrophobicity, and/or homogeneity of a resulting coating may be effectively controlled. Furthermore, one or more embodiments include the formation of multi-layer coatings with chemistry differentially controlled in each layer.

It has further been found that the over-spray and the direct-spray may result in coatings of different controlled chemical compositions, and particularly of different carbon atomic percentage of the total atoms in each of the respective coatings. As such, both the direct-spray and the over-spray of an air plasma may be independently modulated such that a coating of controlled chemistry may result therefrom.

As used herein and unless otherwise noted, the term "direct-spray component" refers to a spray zone that forms a coating from reactive fragments of pre-polymer molecules contacting and cross-linking on a substrate surface contemporaneously subjected to contact with an air plasma stream.

As used herein and unless otherwise noted, the term "over-spray component" refers to a spray zone that forms a coating from reactive fragments of pre-polymer molecules contacting and cross-linking on a substrate surface not subjected to additional contact with an air plasma stream.

Figure 1C:
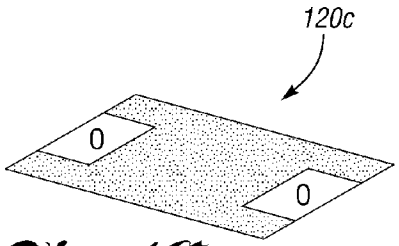
FIGS. 1A-1H depict various spray profiles of a plasma output emitted from a plasma gun referred to in FIG. 1.

According to at least one aspect of the present invention, a method is provided for forming a polymerized coating on a surface of a substrate. In at least one embodiment, and as depicted in FIGS. 1, 1A-1H, and 2A-2B, the method comprises providing a plasma gun 102 having an outlet 106; introducing at least one pre-polymer molecule 108 into the outlet 106 of the plasma gun 102 to form a number of fragments of the pre-polymer molecule as a plasma output 110 including a direct-spray component 112 and an over-spray component 114; at least partially isolating the direct-spray component 112 and the over-spray component 114 from each other to respectively obtain an isolated directed-spray component (such as region "D" in FIG. 1B) and an isolated over-spray component (such as region "O" in FIG. 1B); and as depicted in FIG. 2B, depositing at least a portion of the isolated direct-spray component and the isolated over-spray component onto the surface 207 of the substrate 206 through the outlet to form a base polymerized coating. The plasma gun is optionally operated at atmospheric pressure.

In certain particular instances, the at least one pre-polymer molecule may be introduced into the outlet 106 via a pipe 107. The pipe 107 may be attached to or built integral to the outlet 106. It is appreciated that the pipe 107 should be made of a material or be maintained in a condition that is compatible with the temperature of the pre-polymer molecule 108 to be introduced. By way of example, the pipe 107 should be heated and the material of the pipe 107 should sustain a particularly elevated temperature, in the event when the pre-polymer molecule 108 is introduced in a gas phase, such as unnecessary condensation may be effectively reduced or eliminated.

In at least yet another embodiment, the isolating step further includes, as depicted in FIGS. 1A-1H and will be described in more detail below, shielding at least partially the direct-spray component and/or the over-spray component to respectively form the isolated direct-spray component and the isolated over-spray component.

Examples of surfaces that may be candidates for coating as described herein may include, but are not limited to, glassy material, a laminated windshield, glass for a vehicle, glass, corroded glass, glass having a frit, tinted glass, silicates, aluminates, borates, zirconia, transition metal compounds, steel, carbonates, bio-compatible material, calcium phosphate mineral, tetracalcium phosphate, dicalcium phosphate, tricalcium phosphate, monocalcium phosphate, monocalcium phosphate monohydrate, hydroxyapatite, laminated circuit boards, epoxy, wood, textile, natural fiber, thermoplastics, and thermoset plastics.

The isolating step may be facilitated by the use of a nozzle adaptor. As shown in FIG. 1A, the nozzle adaptor may be attached to the outlet 106 of the plasma gun 102 and the nozzle adaptor may take a cross-sectional exit form in the shape of a rectangular slit, a square, a circle, an oval, or any shape suitable for an application.

In at least another embodiment, and as depicted in FIG. 1A, a nozzle adaptor 116 having a cross-sectional rectangular exit 118 is attached to the plasma outlet 106 such that the over-spray component 114 (FIG. 1) and the direct-spray component 112 (FIG. 1) may each be independently and selectively shielded to respectively form the isolated over-spray component and the isolated direct-spray component.

In at least one particular embodiment, and as depicted in a cross-sectional view in FIG. 1A, a controlled plasma output 120*a* as emitted from the nozzle adaptor 116 is shown to have nine regions wherein a center region "IX" corresponds to an isolated direct-spray component originating from the direct-spray component 112; and regions "I" to "VIII" correspond to various sections of an isolated over-spray component originating from the over-spray component 114.

Figure 1B:
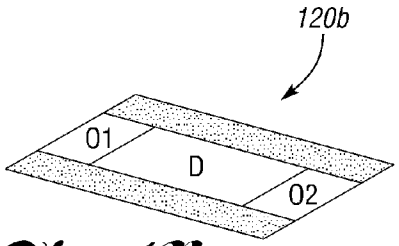
Figure 1A:
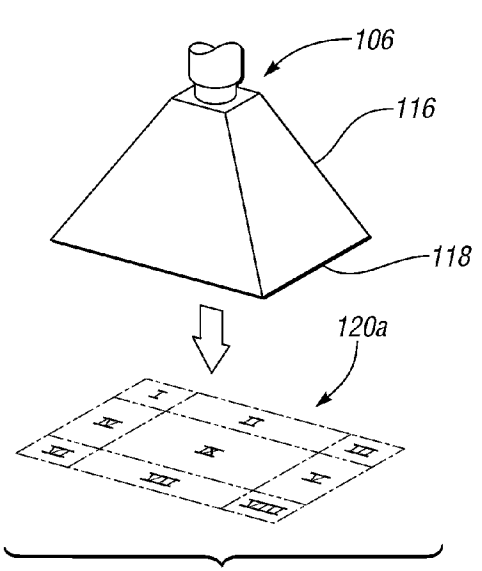

As depicted in FIG. 1B, a laterally elongated spray profile is formed from the exit 118 when the spray regions "I" to "III" and "VI" to "VIII" are blocked or shielded to substantially preclude plasma flow. As the plasma gun 102 moves in the direction shown in FIG. 2A, the controlled plasma output 120*b* may result in the formation of a three-layer coating wherein the layers are deposited in a sequential manner with an intermediate layer of coating formed from the isolated direct-spray component "D", wherein the intermediate layer is flanked by two separate coatings formed from the isolated over-spray components "$O_1$" and "$O_2$".

As depicted in FIG. 1C, a discontinuous lateral spray profile is formed from the exit 118 when the plasma regions "I" to "III", "VI" to "VIII", and "IX" are shielded to substantially preclude plasma flow. As the plasma gun 102 moves in the direction shown in FIG. 2A, the controlled plasma output 120*c* may result in the formation of a two-layer coating wherein the layers are deposited in a sequential manner with each layer having the chemical composition corresponding to the isolated over-spray component "O".

Figure 1E:
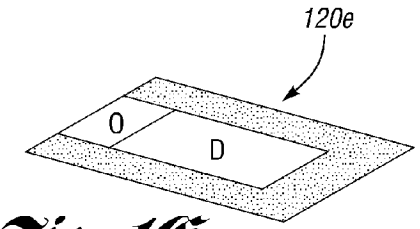
Figure 1D:
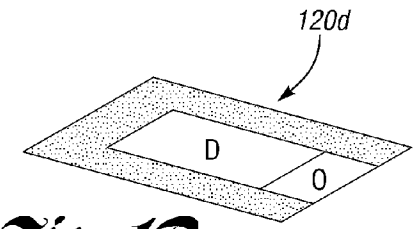

As depicted in FIG. 1D, a laterally aligned spray profile is formed from the exit 118 when the spray areas "I" to "IV" and "VI" to "VIII" are blocked or shielded to substantially preclude plasma flow. As the plasma gun 102 moves in the direction shown in FIG. 2A, the controlled plasma output 120*d* may result in the formation of a two-layer coating wherein the layers are deposited in a sequential manner with a first layer having the chemical composition corresponding to the isolated over-spray component "O" and a second layer having the chemical composition corresponding to the isolated direct-spray component "D".

As depicted in FIG. 1E, a laterally aligned spray profile is formed from the exit 118 when the spray areas "I" to "III" and "V" to "VIII" are blocked or shielded to substantially preclude plasma flow. As the plasma gun 102 moves in the direction shown in FIG. 2A, the controlled plasma output 120*e* may result in the formation of a two-layer coating wherein the layers are deposited in a sequential manner with a first layer having the chemical composition corresponding to the isolated direct-spray component "D" and a second layer having the chemical composition corresponding to the isolated over-spray component "O".

Figure 1F:
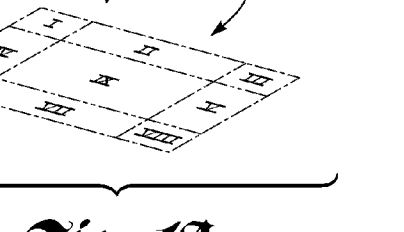

As depicted in FIG. 1F, a singular direct-spray profile is formed from the exit 118 wherein the spray areas "I" to "VIII" are all blocked or shielded to substantially preclude plasma flow and only the spray region "IX" remains open. As the plasma gun 102 moves in the direction shown in FIG. 2A, the controlled plasma output 120*f* may result in the formation of a single-layer coating having the chemical composition corresponding to the isolated direct-spray component "D".

Figure 1H:
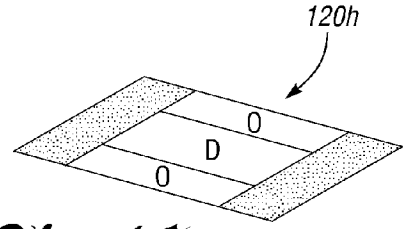
Figure 1G:
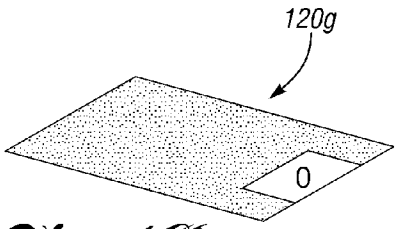

As depicted in FIG. 1G, a singular over-spray profile in area V is formed from the exit 118 when the spray areas "I" to "IV", "VI" to "VIII", and "IX" are all blocked or shielded to substantially preclude plasma flow. As the plasma gun 102 moves in the direction shown in FIG. 2A, the controlled plasma output 120*g* may result in the formation of a single-layer coating having the chemical composition corresponding to the isolated over-spray component "O".

As depicted in FIG. 1H, a longitudinally aligned spray profile in areas II, IX, VII is formed from the exit slit when the spray areas "I", "IV", "VI", "III", "V", and "VIII" are blocked or shielded to substantially preclude plasma flow through these areas. As the plasma gun 102 moves in the direction shown in FIG. 2A, the controlled plasma output 120*h* may result in the formation of a single-layer coating of distinctive regions each respectively having the chemical composition corresponding to the isolated over-spray component "O" or the isolated direct-spray component "D".

Each of the above-illustrated spray regions "I" to "IX" may have its certain portions further shielded, and as such, a controlled plasma output may be obtained with additional variation in spray intensity along with variations in spray profiles 120*a*-120*h*.

In addition, each of the above-illustrated spray regions "I" to "IX" may be pre-mixed before being deposited onto a surface, and as such, a controlled plasma output may be obtained with additional variation in spray composition along with variations in spray profiles 120*a*-120*h*.

In at least one particular embodiment, coatings with various carbon and oxygen contents may be obtained through the adjustment of the output ratio between the direct-spray and the over-spray. By way of example, a coating having 40 atomic percentage of carbon atoms may be obtained when half of the coating in volume comes from the direct-spray having an average of 20 atomic percentage of carbon atoms and the other half of the coating in volume comes from the over-spray having an average of 60 atomic percentage of carbon atoms. An off-exit mixer may be attached to the plasma outlet to ensure a thorough mixing of the relative portions of the direct-spray and the over-spray. As such, a coating may be obtained of any controlled carbon content between the carbon content of the direct-spray and the over-spray.

The flexibility and versatility in controlling the coating chemistry is further bolstered when the carbon content of the direct-spray or the over-spray is itself adjustable. The greater is the differential carbon content between the direct-spray and the over-spray, the more controllably versatile the resulting coating chemistry becomes.

In at least another particular embodiment, multi-layer coatings may be obtained through the use of the plasma nozzle adaptor having a rectangular slit exit form as depicted in FIGS. 1B-1H.

Figure 2A:
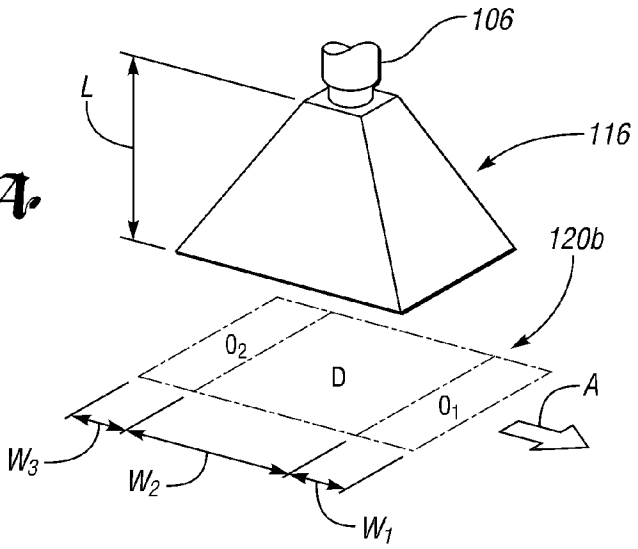
FIGS. 2A and 2B each schematically depicts a process for forming a number of coatings on a substrate surface according to one embodiment.
Figure 2B:
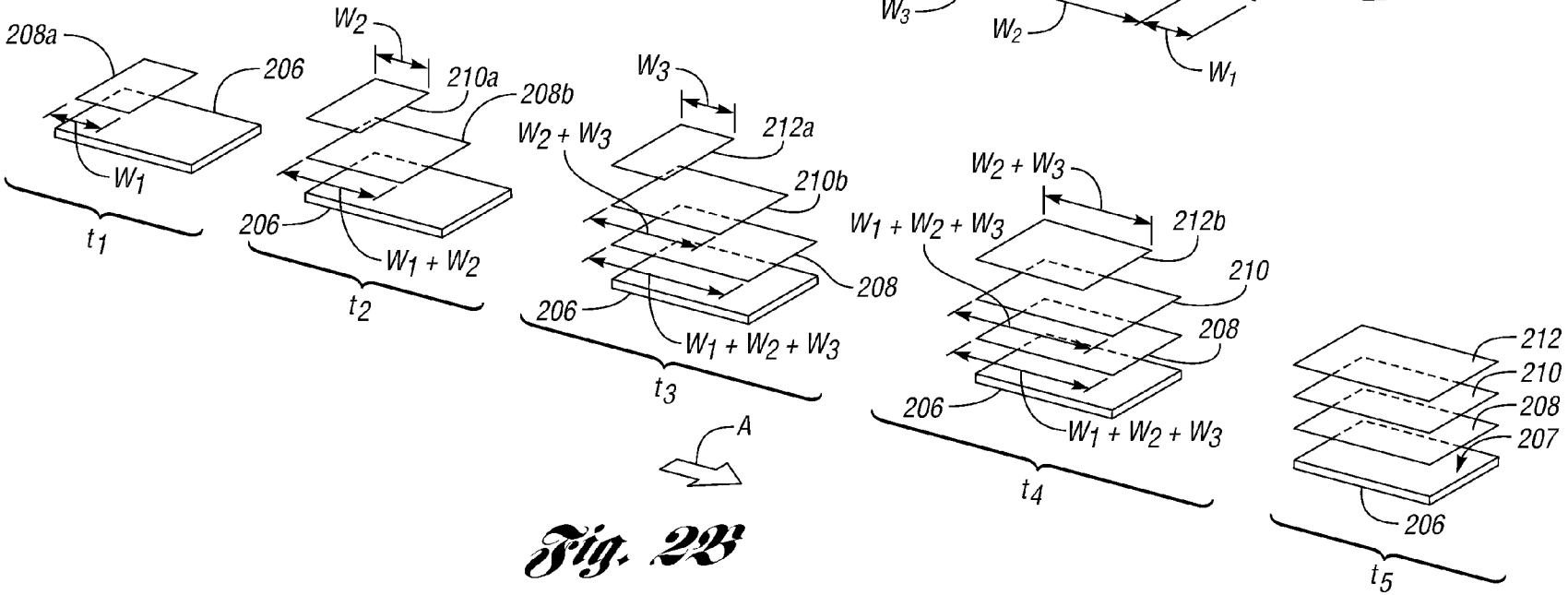

By way of example, and as illustrated in FIG. 2A, the controlled plasma output 120*b* is shown to have separate regions "$O_1$", "$O_2$", and "D", respectively representing "over-spray region 1", "over-spray region 2", and "direct-spray region D." As the plasma gun 102 travels in the direction of arrow "A" shown, plasma spray through separate depositing regions of the controlled plasma output 120*b*, in the order of $O_1$, D, and $O_2$, sequentially gets deposited onto the surface 207 of the substrate 206 and forms coating layers 208, 210, 212, respectively. The coating layer 208 is of a composition corresponding to the composition of over-spray region $O_1$; the coating layer 210 is of a composition corresponding to the composition of direct-spray region D; and the coating layer 212 is of a composition corresponding to the composition of over-spray region $O_2$.

Due to the sequential manner in which the plasma spray is deposited, various coating stages may result and are subjected to differential width measurements of each depositing region along the direction "A". To illustrate and as shown in FIG. 2A, regions $O_1$, D, and $O_2$ each have a width designated as $W_1$, $W_2$, and $W_3$, respectively.

At time $t_1$, partial coating layer 208*a* having a lateral length equivalent of $W_1$ is formed. At time $t_2$, the partial coating layer 208*a* is extended to be 208*b* having a lateral length equivalent of "$W_1+W_2$"; and at the same time, a partial coating layer 210*a* is formed as having a lateral length equivalent of $W_2$. At time $t_3$, the partial coating layer 208*b* is extended to become the coating layer 208 as referenced earlier as having the full lateral length equal to "$W_1+W_2+W_3$; the partial coating layer 210*a* is further extended to a partial coating layer 210*b* having a lateral length equivalent of "$W_2+W_3$"; and a partial coating layer 212*a* is formed as having a lateral length equivalent of "$W_3$". At time $t_4$, the partial coating layer 210*b* is extended to become the coating layer 210 as referenced earlier as having the full lateral length equal to "$W_1+W_2+W_3$"; and the partial coating layer 212*a* is extended in the direction of "A" to become a partial coating layer 212*b* having a lateral length equivalent of "$W_2+W_3$". Finally, at time $t_5$, the partial coating layer 212*b* is extended fully to become the coating layer 212 as referenced above as having a lateral length equal to "$W_1+W_2+W_3$".

Figure 3:
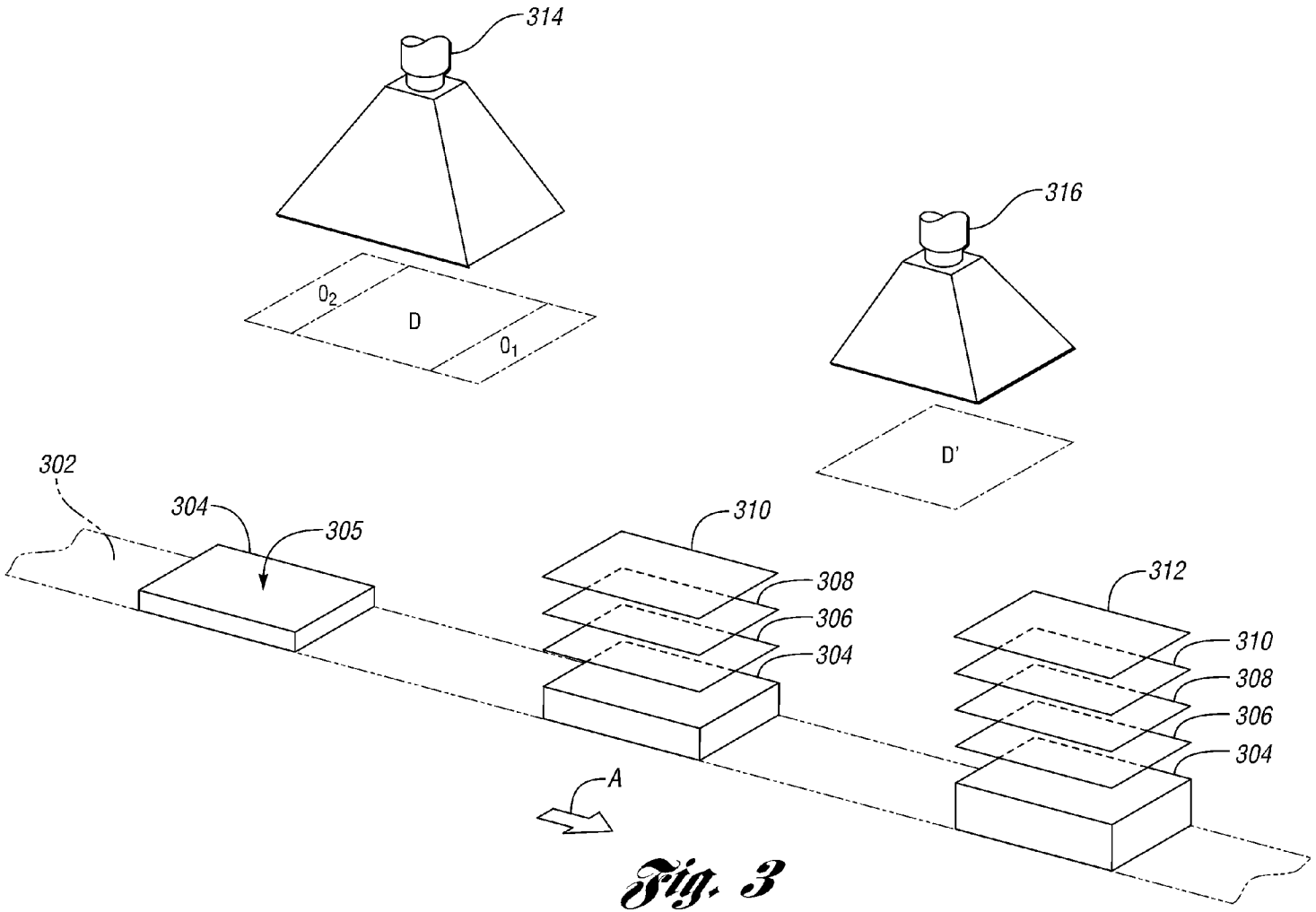
FIG. 3 depicts an in-line process using different plasma depositing devices for forming a number of coatings on a substrate surface according to one embodiment.

In at least another embodiment, the multi-layer coatings may be obtained through the use of two or more plasma guns 314, 316 in an in-line process as shown in FIG. 3. Each plasma gun delivers at least one layer of coating on the surface of the substrate with a controlled chemistry and a time delay between depositions of any two layers may be programmed and controlled by conveyor 302. By way of example, and as illustrated in FIG. 3, as substrate 304 having a surface 305 is moved in direction A by conveyor 302, a first layer of coating is a hydrophilic tie-coat 306; a second layer of coating is a hydrophobic barrier coating 308; and a third layer of coating 310 is again hydrophilic to promote bonding to a subsequently applied layer of paint 312.

For each plasma spray profile illustrated in FIGS. 1A-1G, a controlled plasma output may further be obtained by shielding independently each of the spray regions. In at least one embodiment, the controlled plasma output is obtained by modifying a ratio of the isolated over-spray component relative to the over-spray component of the plasma output in a particular coating application, whereas the over-spray component is set at 100%. For example, and as illustrated in FIG. 1C, the un-shaded areas representing the over-spray regions of "IV" and "V" are emitting a maximum amount of over-spray output relative to the configuration specific to FIG. 1C. However, the un-shaded areas "IV" and "V" may each be independently shielded, optionally in a reversible manner, such that an adjusted over-spray output with a particular percentage to the maximum 100% is obtained. The ratio, based on the over-spray output relative to the maximum of 100%, is in a range independently selected from no less than 0%, 10%, 20%, 30%, 40%, or 50%, to no greater than 100%, 90%, 80%, 70%, or 60%.

In at least another embodiment, a ratio of the isolated direct-spray component relative to the direct-spray component of the plasma output may be enabled in a particular coating application, whereas the maximum direct-spray output is set at 100%. For example, and as illustrated in FIG. 1F, the un-shaded area representing the direct-spray region "IX" emits a maximum amount of the direct-spray output relative to the configuration specific to FIG. 1F. However, the un-shaded area "IX" may be at least partially shielded, optionally in a reversible manner, such that an adjusted direct-spray output with a particular percentage to the maximum 100% is obtained. The ratio, based on the direct-spray output relative to the maximum of 100%, is in a range independently selected from no less than 0%, 10%, 20%, 30%, 40%, or 50%, to no greater than 100%, 90%, 80%, 70%, or 60%.

The extent and composition of the plasma output may further be modified by modulating the level of plasma energy imparted during a plasma depositing process. As a result, the amount of the direct-spray component or the amount of the over-spray component may be altered accordingly. This base level output modification, when coupled with various shielding and mixing described herein, creates substantial versatility in controlling the chemistry of a plasma coating resulting therefrom.

Extent of energy imparted during a plasma depositing process is a function of several factors including beam speed and nozzle distance. Generally, higher the beam speed, the greater the nozzle distance, the lower the energy imparted. In certain particular embodiments wherein a lower energy output is desired, the beam speed is illustratively in the range of 200 to 800 millimeters per second and more particularly of 300-600 millimeters per second; the nozzle distance is illustratively in the range of 15 to 60 millimeters and more particularly of 20 to 30 millimeters; and a power level is in the range of 40 to 70% PCT (plasma pulse width). In certain other particular embodiments wherein a higher energy output is desired, the beam speed is illustratively in the range of 0.5 to 200 millimeters per second and more particularly of 25 to 100 millimeters per second; the nozzle distance is illustratively in the range of 0.5 to 15 millimeters and more particularly of 4 to 10 millimeters; and a power level is in the range of 70 to 100% PCT (plasma pulse width).

The methods described herein may be applicable to various plasma depositing technologies. These technologies illustratively include Corona plasma, flame plasma, chemical plasma, and atmospheric pressure air plasma (APAP).

Corona plasma generally uses a high-frequency power generator, a high-voltage transformer, a stationary electrode, and a treater ground roll. Standard utility electrical power is converted into higher frequency power which is then supplied to a treater station. The treater station applies this power through ceramic or metal electrodes over an air gap onto a surface to be treated.

Flame plasma treaters generate typically more heat than other treating processes, but materials treated through this method tend to have a longer shelf-life. These plasma systems are different than air plasma systems because flame plasma occurs when flammable gas and surrounding air are combusted together into an intense blue flame. Surfaces are polarized from the flame plasma affecting the distribution of the surfaces' electrons in an oxidation form. Due to the high temperature flammable gas that impinges on the surfaces, suitable methods should be implemented to prevent heat damages to the surfaces.

As known in the art, chemical plasma is often categorized as a combination of air plasma and flame plasma. Somewhat like air plasma, chemical plasma is delivered by electrically charged air. Yet, chemical plasma also relies on a mixture of other gases depositing various chemical groups onto a to-be-treated surface. When a chemical plasma is generated under vacuum, surface treatment may be effectuated in a batch process (such as when an article is singly located within a vacuumed chamber for treatment) rather than an in-line process (such as when a plurality of articles are sequentially lined-up for treatment).

Air plasma is similar to Corona plasma yet with differences. Both air plasma and Corona plasma use one or more high voltage electrodes which positively charge surrounding air ion particles. However in air plasma systems, the rate of oxygen deposition onto a surface is substantially higher. From this increase of oxygen, a higher ion bombardment occurs. By way of example, an exemplary air plasma treatment method is illustratively detailed in the U.S. Patent Publication titled "method of treating substrates for bonding" (publication number US 2008-0003436, which is now U.S. Pat. No. 7,744,984), the content of which is incorporated herein in its entirety by reference.

The pre-polymer molecule 108 may be introduced in the form of a powder, a particle, a liquid, a gas, or any combinations thereof.

Suitable pre-polymer molecule 108 illustratively includes linear siloxanes; cyclical siloxanes; methylacrylsilane compounds; styryl functional silane compounds; alkoxyl silane compounds; acyloxy silane compounds; amino substituted silane compounds; hexamethyldisiloxane; tetraethoxysilane; octamethyltrisiloxane; hexamethylcyclotrisiloxane; octamethylcyclotetrasiloxane; tetramethylsilane; vinylmethylsilane; vinyl triethoxysilane; vinyltris(methoxyethoxy) silane; aminopropyltriethoxysilane; methacryloxypropyltrimethoxysilane; glycidoxypropyltrimethoxysilane; hexamethyldisilazane with silicon, hydrogen, carbon, oxygen, or nitrogen atoms bonded between the molecular planes; organosilane halide compounds; organogermane halide compounds; organotin halide compounds; di[bis(trimethylsilyl) methyl]germanium; di[bis(trimethylsilyl)amino] germanium; tetramethyltin; organometallic compounds based on aluminum or titanium; or combinations thereof. Candidate prepolymers do not need to be liquids, and may include compounds that are solid but easily vaporized. They may also include gases that are compressed in gas cylinders, or are liquefied cryogenically, or are vaporized in a controlled manner by increasing their temperature.

According to at least another aspect of the present invention, an article having a coated surface adapted for enhanced adhesive bonding is provided according to the methods described herein. In at least one embodiment, and as depicted in FIG. 2B, the article comprises a substrate 206 having a surface 207; a first polymerized coating 208 in contact with the surface and having a first controlled chemistry; and a second polymerized coating 210 in contact with the surface and/or the first polymerized coating, the second polymerized coating having a second controlled chemistry; wherein the first and the second polymerized coatings are each a cross-linked polymer of randomly fragmented pre-polymer molecules; wherein a carbon differential between the first and the second polymerized coatings, based on carbon atomic percentage of the total atoms in each of the coatings, is between 15 to 65 percent.

As used herein and unless otherwise noted, the term "controlled chemistry" refers to chemical composition having a pre-determined concentration in at least one atom, with the atom illustratively including carbon, oxygen, sulfur, magnesium, nitrogen, silicon, and phosphorus. In at least one particular embodiment, the controlled chemistry is referred to a pre-determined carbon concentration of a coating.

In at least another embodiment, the first and the second polymerized coatings each independently have a carbon atomic percent, based on the total atoms of each of the coatings, in a range of 1 to 60 percent to respectively obtain the first and the second controlled chemistry. The pre-polymer molecule is optionally hexamethyldisiloxane.

In at least yet another embodiment, the first polymerized coating has a carbon atomic percent, based on the total atoms of the second polymerized coating, in a range of 5 to 60 percent to obtain the second controlled chemistry. In at least one particular embodiment, the carbon atomic percent of the second coating is in a range of 10 to 55 percent to obtain the second controlled chemistry. In at least another particular embodiment, the carbon atomic percent of the second coating is in a range of 15 to 45 percent to obtain the second controlled chemistry. In at least yet another particular embodiment, the carbon atomic percent of the second coating is in a range of 20 to 40 percent to obtain the second controlled chemistry. In at least yet another particular embodiment, the carbon atomic percent of the second coating is in a range of 25 to 35 percent to obtain the second controlled chemistry.

In at least yet another embodiment, the second polymerized coating has a carbon atomic percent, based on the total atoms of the second polymerized coating, in a range of 1 to 40 percent to obtain the second controlled chemistry. In at least one particular embodiment, the carbon atomic percent of the second coating is in a range of 2 to 35 percent to obtain the second controlled chemistry. In at least another particular embodiment, the carbon atomic percent of the second coating is in a range of 3 to 30 percent to obtain the second controlled chemistry. In at least yet another particular embodiment, the carbon atomic percent of the second coating is in a range of 5 to 25 percent to obtain the second controlled chemistry.

Both the first and the second controlled chemistry is each independently controlled by several operative conditions. These conditions illustratively include the level of plasma energies imparted into a plasma gun, ways of selective shielding the over-spray component or the direct-spray component such that a controlled plasma output may be obtained, and whether the preselected portions of the over-spray and the direct-spray component are advantageously combined such that the air plasma output may be further modified to obtain the controlled chemistry of each respective coating. These operating conditions are described with more details in sections given below.

In at least yet another embodiment, a carbon differential between the first polymerized coating and the second polymerized coating, based on carbon atomic percent of the total atoms in each of the coatings, is between 15 to 65 percent, in certain instances 20 to 60 percent, in certain instances 25 to 55 percent, in certain instances 30 to 50 percent, and in certain other instances 35 to 45 percent. By way of example, a carbon differential between a first polymerized coating having a carbon atomic percent of 20% and a second polymerized coating having a carbon atomic percent of 30% is (30-20) %=10%.

Having generally described this invention, a further understanding can be obtained by reference to certain specific examples which are provided herein for purposes of illustration only and are not intended to be limiting unless otherwise specified.

EXAMPLES

Example 1

Atmospheric pressure air plasma (APAP) assisted deposition of coating materials originated from hexamethyldisiloxane (HMDSO) is performed on a silicon wafer having a diameter of 10 cm (centimeters). The coatings are applied using APAP operating conditions indicated in Table 1 given below.

TABLE 1

Coating parameters relative to different plasma depositing conditions

| | Speed of Plasma Beam Millimeters per second (mm/s) | Distance of Plasma Exiting Nozzle to Silicon Wafers Millimeters (mm) | Track Pitch Milli-meters (mm) | Plasma Pulse Width Percent (%) | HMDSO Flow Percent (%) |
|---|---|---|---|---|---|
| Condition "a" | 200 | 10 | 1 | 55 | 100 |
| Condition "b" | 100 | 6 | 1 | 100 | 20 |

Figure 4:
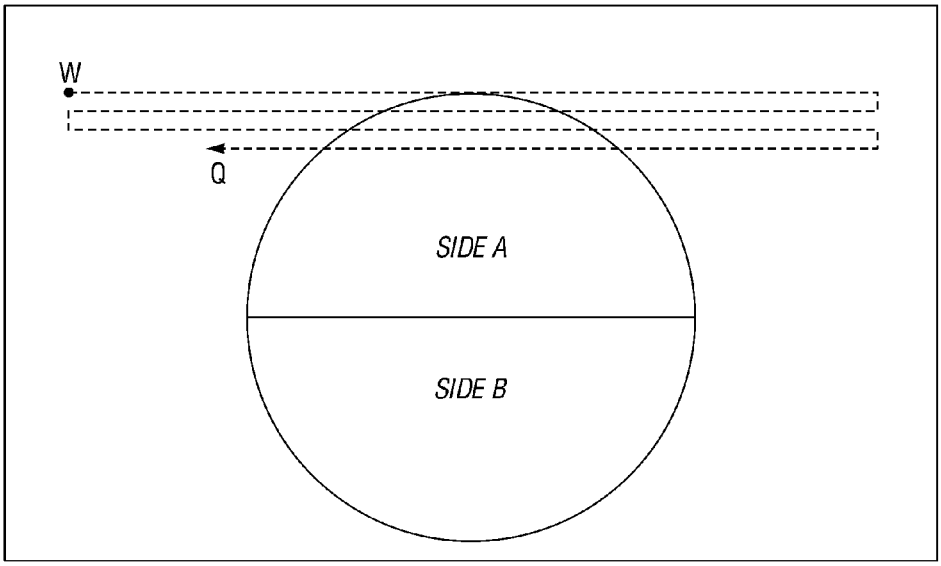
FIG. 4 depicts air plasma coating patterns on a silicon wafer specimen according to one embodiment.

A coating under either condition "a" or condition "b" is applied to one half of the surface of the silicon wafer specimen according to the pattern shown in FIG. 4. The track pitch is defined as the distance between sweeps as the air plasma head traverses back and forth across the specimen.

Compared to the condition "b", the condition "a" is conducted at a lower power level of 55% PCT (plasma pulse width), a greater beam speed of 200 millimeters per second (and thereafter "mm/s"), and a greater nozzle distance of 10 mm. The condition "a" is chosen to illustrate a situation where less energy is imparted into the pre-polymer molecule HMDSO. Similarly, the condition "b" is chosen to illustrate a situation where relatively more energy is imparted into the pre-polymer molecule HDSMO.

Under each of the conditions listed in the Table 1 above, and as illustratively shown in FIG. 4, a plasma beam, in a raster pattern illustrated as from point "W" to point "Q", moves across an upper half (marked as "side A") of the silicon wafer specimen while leaving an lower half (marked as "side B") not directed by the plasma beam. Because the upper half is directed to by the plasma beam, as such, the coating on the upper half or side A of the specimen corresponds to a portion of the direct-spray of the plasma. Likewise, the coating on the lower half or side B of the specimen corresponds to a portion of the over-spray of the plasma.

It is interesting to find that the side B of the specimen also appears to have a coating even though the side B is not directed to by the plasma beam.

X-ray photoelectron spectroscopy (XPS) surveys and depth profiles are acquired for both the side A and side B of the specimen. Atomic compositions of the coating on either the side A or the side B are recorded in Table 2 given below.

As reported in the Table 2 below, the word "hexane" refers to when a relevant coating has been subjected to sonication and hexane extraction. The word "initial" refers to when a relevant coating has not been subjected the sonication or the hexane extraction. Hexane solubilizes HMDSO if HMDSO or fragments thereof in the respective coating are not otherwise cross-linked and polymerized.

TABLE 2

Atomic Compositions of Coatings Formed under Condition "a" or "b"

| Description | | Treatment | Atomic Composition Percent (%) Carbon (C) | Oxygen (O) | Silicon (Si) | Ratio O/Si |
|---|---|---|---|---|---|---|
| Condition "a" | Side A | Initial | 20.5 | 53.8 | 25.7 | 2.1 |
| | | Hexane | 21.6 | 53.2 | 25.2 | 2.1 |
| | Side B | Initial | 26.5 | 49.0 | 24.5 | 2.0 |
| | | Hexane | 26.8 | 48.4 | 24.8 | 2.0 |
| Condition "b" | Side A | Initial | 10.6 | 62.0 | 27.4 | 2.3 |
| | | Hexane | 10.7 | 61.8 | 27.5 | 2.2 |
| | Side B | Initial | 18.2 | 56.7 | 25.1 | 2.3 |
| | | Hexane | 18.4 | 56.9 | 24.7 | 2.3 |

As shown in the Table 2 above, within each condition, hexane sonication does not significantly affect coating compositions relative to initial counterparts. This indicates the respective coatings on both the side A and the side B are cross-linked and polymerized.

Regardless of the extent of energy imparted by the plasma deposition processes, the over-spray region "side B" has a higher carbon atomic percent relative to the direct-spray region of "side A".

Relative to condition "a", the coating on "side B" due to over-spray has a carbon atomic percent of 26.5% whereas the coating on "side A" due to direct-spray had a carbon atomic percent of 20.5%. As such, relative to condition "a", the over-spray coating on "side B" possesses a 30 percent increase in the carbon atomic percent when compared to the direct-spray coating on "side A".

Likewise relative to condition "b", the over-spray coating on "side B" has a carbon atomic percent of 18.2% whereas the direct-spray coating on "side A" has a carbon atomic percent of 10.6%. In this comparison, over-spray coating possesses a 53 percent increase in the carbon atomic percent relative to the direct-spray coating.

Also as shown in the Table 2 above, between condition "a" and condition "b", the "initial" coatings under condition "b" contain significantly less carbon atoms in atomic percent of the total atoms in each relevant coating. This suggests that higher power to pre-polymer ratio coincident with the slower beam speed and shorter nozzle distance, as is the case in condition "b", results in a higher oxidation of the carbon atoms, a lower percentage of free carbon atoms, and hence a higher extent of inorganic character and hydrophobicity.

Example 2

Depth Profile Characterization by Argon Sputtering

The coated specimens according to Table 2 above are further characterized by depth profile analysis using argon sputtering and the analysis results are depicted in FIG. 5-8 respectively. The profiles are presented in respective atomic percent plotted against argon etching duration recorded in seconds. A particular etch time point when the level of silicon atomic percentage suddenly increases is proportional to the thickness of a coating since a large amount of silicon atoms reside on the surface and within the body of the silicon wafer itself and the sudden increase in silicon content is indicative that the coating has been etched away and that the underlying silicone-containing surface is exposed.

Figure 5:
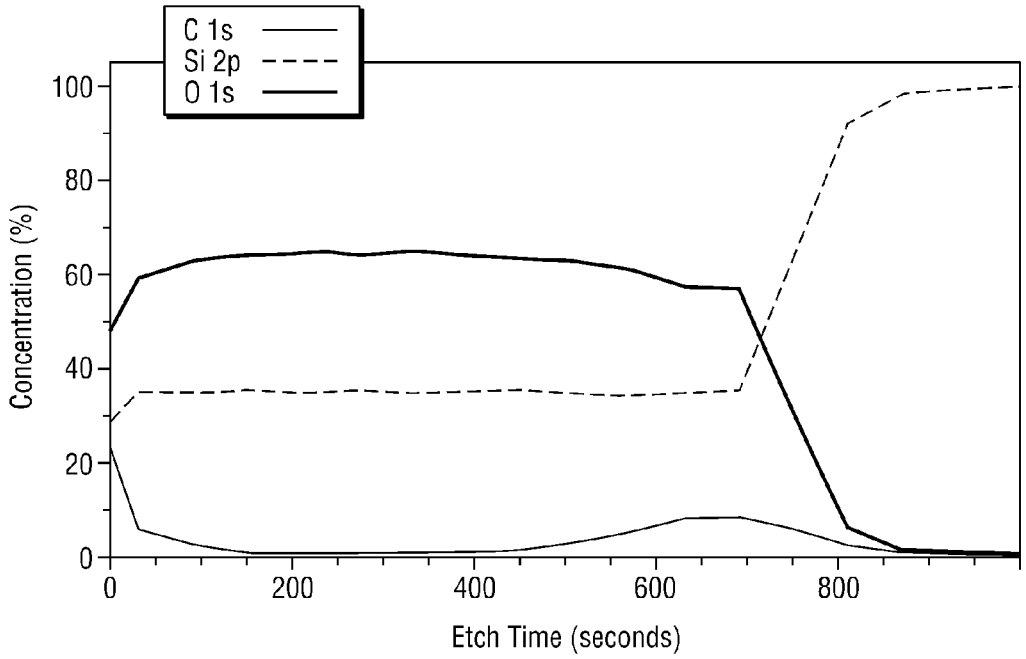
FIG. 5 depicts X-ray photoelectron spectroscopy (thereafter "XPS") depth profiles of side "A" coatings deposited under condition "a" according to one embodiment.

FIG. 5 depicts XPS depth profiles of the side "A" coatings deposited under condition "a". As illustrated in FIG. 5, a sudden increase in silicon percentage is observed at the etch time point of about 700 seconds.

Figure 6:
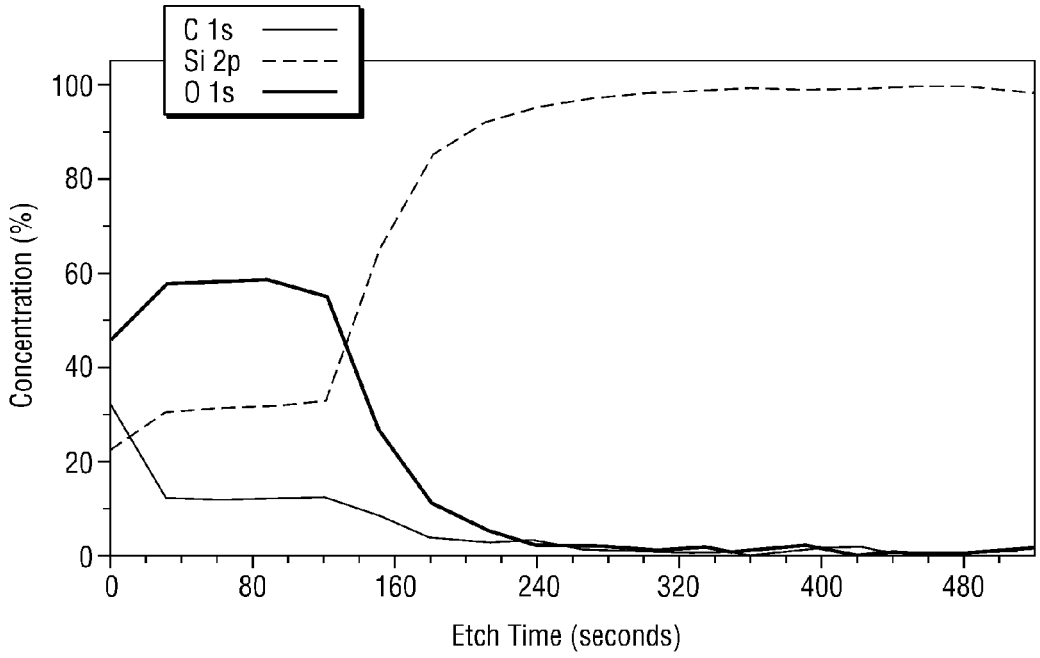
FIG. 6 depicts XPS depth profiles of side "B" coatings deposited under condition "a" according to one embodiment.

FIG. 6 depicts XPS depth profiles of the side "B" coatings deposited under condition "a". As illustrated in FIG. 6, a sudden increase in silicon percentage is observed at the etch time point of about 130 seconds. Relative to the coating on the side "A" referenced in FIG. 5, the side "B" here is a much thinner coating as revealed by the argon sputtering.

Figure 7:
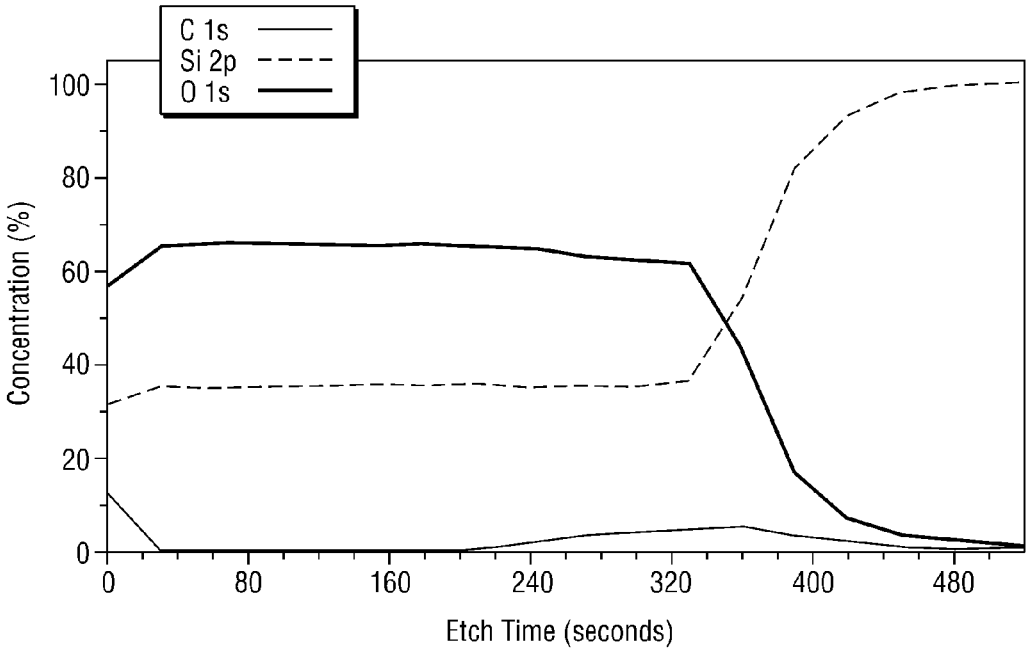
FIG. 7 depicts XPS depth profiles of side "A" coatings deposited under condition "b" according to one embodiment.

FIG. 7 depicts XPS depth profiles of the side "A" coatings deposited under condition "b". As illustrated in FIG. 7, a sudden increase in silicon percentage is observed at the etch time point of about 330 seconds. Relative to the coating on the side "A" referenced in FIG. 5, the coating on the side "A" is much thinner as revealed by the argon sputtering.

Figure 8:
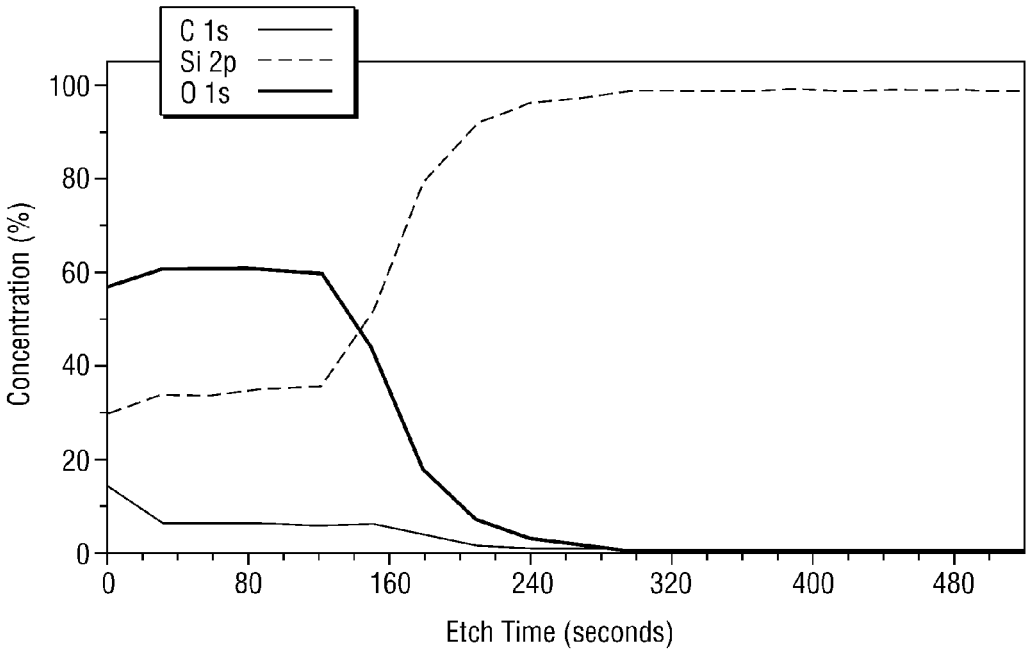
FIG. 8 depicts XPS depth profiles of side "B" coatings deposited under condition "b" according to one embodiment.

FIG. 8 depicts XPS depth profiles of the side "B" coatings deposited under condition "b". As illustrated in FIG. 8, a sudden increase in silicon percentage is observed at the etch time point of about 140 seconds.

Graphs as depicted in FIGS. 5-8 are consistent with the understanding that, during application of the coating in the zigzag pattern (see FIG. 4), an over-spray precedes a direct impinged coating put down by the air plasma stream. This is because, as the air plasma stream impinges on the surface, a wall jet containing plasma-activated reactive species is formed that spreads out 360 degrees across the flat sample. The over-spray in the wall jet deposits a over-spray coating more enriched in carbon atoms relative to the film that is directly impinged by the air plasma stream. As deposition proceeds and the air plasma head traverses further across the sample, the over-spray in the wall jet reacts to form an additional film on the surface of the main coating that is applied by direct impingement. Thus the resultant applied coating ends up being composed of 1) a carbon enriched underlying over-spray region, corresponding to an etch time of 550 to 800 seconds as revealed in FIG. 5 and an etch time of 260 to 420 seconds as revealed in FIG. 7; 2) a bulk region of direct air plasma contact depleted in carbon atoms, corresponding to an etch time of 100 to 550 seconds as revealed in FIG. 5 and an etch time of 30 to 260 seconds as revealed in FIG. 7; and 3) a surface over-spray region again enriched in carbon atoms, corresponding to an etch time of 0 to 100 seconds as revealed in FIG. 5 and an etch time of 0 to 30 seconds as revealed in FIG. 7.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

plasma direct-spraying through a nozzle adaptor exit region to form a direct-spray component onto a substrate;

plasma over-spraying through the nozzle adaptor exit region to form an over-spray component onto the substrate; and placing a shield to block various portions of the nozzle adaptor exit region to form the direct- and/or over-spray component to form a plasma coating contacting at least a portion of the substrate.

2. The method of claim 1, wherein the direct-spray component includes a single bounded direct-spray region, and the over-spray component includes a single bounded over-spray region adjacent to the single bounded direct-spray region.

3. The method of claim 1, wherein the direct-spray component includes a single bounded direct-spray region, and the over-spray component includes first and second discrete over-spray subcomponents including first and second bounded over-spray regions adjacent to the single bounded direct-spray region.

4. The method of claim 3, wherein the first and second bounded over-spray regions are not adjacent to each other.

5. The method of claim 1, wherein each of the direct-spray and over-spray components has a different cross-linked polymer chemistry.

6. The method of claim 1, wherein the direct- and over-spraying steps are performed in a single pass to form the plasma coating.

7. A method comprising:

plasma direct-spraying through a nozzle adaptor exit region to form a direct-spray component onto a substrate; and plasma over-spraying through the nozzle adaptor exit region to form an over-spray component onto the substrate; and placing a shield to block various portions of the nozzle adaptor exit region to form the direct- and/or over-spray component to form a plasma coating contacting less than the entire substrate.

8. The method of claim 7, wherein the direct-spray component includes a single bounded direct-spray region, and the over-spray component includes a single bounded over-spray region adjacent to the single bounded direct-spray region.

9. The method of claim 7, wherein the direct-spray component included a single bounded direct-spray region, and the over-spray component includes first and second discrete over-spray subcomponents including first and second bounded over-spray regions adjacent to the single bounded direct-spray region.

10. The method of claim 9, wherein the first and second bounded over-spray regions are not adjacent to each other.

11. The method of claim 7, wherein each of the direct-spray and over-spray components has a different cross-linked polymer chemistry.

12. The method of claim 7, wherein the plasma direct-spraying and over-spraying steps are performed in a single pass to form the plasma coating.

13. A method comprising:

plasma direct-spraying through a nozzle adaptor exit region to form a direct-spray component onto a substrate;

plasma over-spraying through the nozzle adaptor exit region to form an over-spray component onto the substrate; and placing a shield to block various portions of the nozzle adaptor exit region to form the direct- and/or over-spray component, each having a different cross-linked polymer chemistry.

14. The method of claim 13, wherein the direct-spray component includes a single bounded direct-spray region, and the over-spray component includes a single bounded over-spray region adjacent to the single bounded direct-spray region.

15. The method of claim 13, wherein the direct-spray component included a single bounded direct-spray region, and the over-spray component includes first and second discrete over-spray subcomponents including first and second bounded over-spray regions adjacent to the single bounded direct-spray region.

16. The method of claim 15, wherein the first and second bounded over-spray regions are not adjacent to each other.

17. The method of claim 1, wherein the exit region is a rectangular exit region.

18. The method of claim 1, wherein the shielding step includes blocking the exit region to substantially preclude flow of the direct- and/or over-spray in the exit region to form the direct- and/or over-spray component.

19. The method of claim 1, wherein the delivering step is performed before the shielding step.

20. The method of claim 1, wherein the shielding step includes shielding one or more subregions of the exit region.

* * * * *